United States Patent [19]

Winter

[11] Patent Number: 4,578,985

[45] Date of Patent: Apr. 1, 1986

[54] DIE WITH SOLID PARTICLE REMOVAL GROOVE

[75] Inventor: Joseph Winter, New Haven, Conn.

[73] Assignee: Olin Corporation, New Haven, Conn.

[21] Appl. No.: 649,776

[22] Filed: Sep. 12, 1984

[51] Int. Cl.[4] ..... B21C 3/00

[52] U.S. Cl. ..... 72/467; 72/274; 72/463; 76/107 A

[58] Field of Search ..... 72/274, 285, 463, 467; 76/107 A

[56] References Cited

U.S. PATENT DOCUMENTS 157,653 12/1874 Tasker .
550,724 12/1895 Phillips .
880,563 3/1908 McTear ..... 72/274
1,957,234 5/1934 Schroter et al. ..... 72/463
4,403,491 9/1983 Wassen et al. .

*Primary Examiner*—W. D. Bray
*Attorney, Agent, or Firm*—Barry L. Kelmachter; Howard M. Cohn; Paul Weinstein

[57] ABSTRACT

The present invention relates to an improved die configuration. The die comprises a body member having an interior passageway defined by a bell portion and a land portion. To improve die efficiency, the bell and land portions are provided with a helical groove for removing solid particles which may dislodge from the workpiece during its passage through the die and may interrupt smooth die operation. A technique for using the die to form a tube is also described.

13 Claims, 3 Drawing Figures

DIE WITH SOLID PARTICLE REMOVAL GROOVE

The present invention relates to an improved die construction having means for removing solid particles from the die interior and thereby promoting improved die operation.

The use of dies in metal forming and working operations is well known in the art. The configuration of these metal forming and/or working dies is generally determined by the particular forming and/or working operation to be performed. For example, where a piece of strip material is to be formed into a tubular member, it is not unusual for a groove to be incorporated into the die structure. This groove generally assists in folding over the edges of the strip material and placing them in an abutting and/or overlapping relationship. In some dies, this groove is used in conjunction with a mandrel. U.S. Pat. Nos. 157,653 to Tasker and 550,724 to Phillips illustrate tube forming dies having a groove and/or a mandrel arrangement.

As well as being used to place the edges of a strip material into contact, a groove may be incorporated into a die to assist in the formation of the tube in general. For example, it is known in the art to form a split tube using a conical mandrel and a die member having a conical bore, a shallow groove in the bore and cylindrical extension. In this tube forming approach, the conical mandrel fills the conical bore except for the groove which merges into an annular space between the cyindrical bore and a cylindrical extension attached to the mandrel. A metal strip is pulled through the shallow groove and folded into a split tube that is pulled out of the die member from the annular space. U.S. Pat. No. 4,403,491 to Wassen et al. illustrates this type of mandrel and groove approach for die forming a split tube.

The use of grooves is known in wire drawing dies as well as in tube forming dies. In the drawing die situation, the groove is typically used to introduce a lubricant into the interior of the die and decrease the frictional forces at the die/workpiece interface. U.S. Pat. No. 1,957,234 to Schroter et al illustrates a drawing die having a helical groove adapted to contain a lubricant.

In designing a die, the type of materials to be worked as well as the type of metal working operation to be performed must be taken into account. In virtually all dies, there exists a critical balance between the physical properties of the workpiece and the forces applied to the workpiece during the working operation as a result of the die configuration. In general it can be said that the forces associated with the die configuration, such as the forces associated with the bell angle of a die and/or the frictional forces associated with the land portion of the die, must not exceed the fracture strength of the workpiece. Obviously, if these forces exceed the workpiece fracture strength, the workpiece will break and the metal working operation will terminate. This critical balance of forces is so sensitive that even small changes in the bell angle or the length of the land portion can adversely affect the balance and limit the permissible workpiece gage and width. Similarly, small changes in the physical properties of the workpiece such as its strength and/or temper can impact the critical balance of forces.

Even after successfully adjusting the various factors to obtain the desired balance of forces, smooth die operation may be interrupted by small solid particles, such as burrs on the workpiece, that become dislodged in the die during the run. Since most dies lack any means for permitting these particles to pass, the end of a run is often characterized by a build-up of these particles that upsets the frictional balance in the die and causes the workpiece to break.

In accordance with the present invention, an improved die construction is provided that overcomes the problem of particle build-up. The die of the present invention may be used for a variety of purposes such as the fabrication of a relatively thin walled tubular structure from a continuous metal or metal alloy strip or the sizing of a workpiece.

The problem of particle build-up is dealt with by providing the die of the present invention with a means for allowing the unwanted solid particles to pass. Preferably, this is accomplished by incorporating a recessed, helical groove into the die structure. This helical groove preferably extends from the inlet of the die to the outlet of the die and is dimensioned to avoid lateral or surface defects in the workpiece. In a preferred embodiment of the present invention, the metal working die comprises a body member having a frusto-conical bell portion and a land portion with a substantially cylindrical bore. The helical groove is recessed into both the bell and land portions of the die and has at least one turn.

It is believed that the helical groove in the die tends to impart a torsional force to the workpiece. This torsional force may cause the workpiece to rotate. Where such rotation can not be tolerated or is undesirable, the effects of the torsional force can be counteracted by counter-rotating the die during the forming operation. In a preferred embodiment, counter-rotation of the die is effected by mounting the die in a rotatable holder and providing a suitable drive means for rotating the holder. Die rotation is also beneficial from the standpoint of insuring that every part of the workpiece sees both the helical groove and the working portions of the die. To obtain the maximum benefits, the die is preferably rotated at a speed in accordance with the following equation:

$$S_r = S_i/(L \times N) \quad (1)$$

where $S_r$ = the speed of rotation;

$S_i$ = the input speed of workpiece;

L = the contact length of the die; and

N = the number of turns of the helical groove.

It is an object of the present invention to provide an improved die configuration for promoting efficient die operation.

It is a further object of the present invention to provide a die as above having means for removing solid particles that can interfere with efficient die operation.

It is a further object of the present invention to provide a die as above that may be used for forming a metal or metal alloy strip into a relatively thin walled tubular structure.

These and other objects and advantages will become more apparent from the followng description and drawings wherein like reference numerals depict like elements.

In accordance with the present invention, an improved die configuration that leads to improved die efficiency is provided. The present invention improves die efficiency by providing the forming and/or working die with a helical groove for removing any unwanted solid particles which may become dislodged in the die. Dies in accordance with the present invention may be used as tube forming dies for forming a continuous metal or metal alloy strip into a tubular structure or may be used as a drawing or sizing die for removing excess material from the outer periphery of a metal or metal alloy workpiece.

Figure 1:
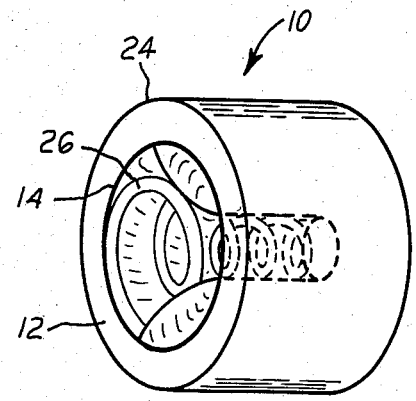
FIG. 1 is a perspective view of the die of the present invention.
Figure 2:
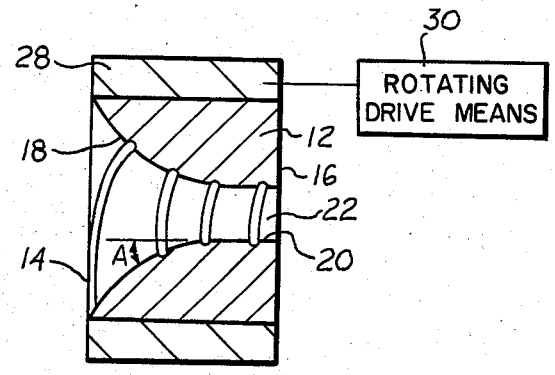
FIG. 2 is a cross sectional view of the die of FIG. 1 mounted in a holder adapted for rotation.

Referring now to FIGS. 1 and 2, a die 10 in accordance with the present invention is illustrated. The die 10 is formed by a body member 12 having an inlet face 14 and an outlet face 16. The interior of the body member is preferably configured to have a passageway through which a workpiece passes. The passageway is defined by a frusto-conical bell portion 18 and a land portion 20 having a substantially cylindrical bore 22. While the body member 12 has been illustrated as having a substantially circular outer periphery 24, it should be recognized that the outer periphery may have any desired shape.

The body member 12 may be formed from any suitable material known in the art. Obviously, the material chosen for the body member will depend to a certain extend upon the material or materials being worked. Suitable materials from which the body member can be formed include, but are not limited to, hardened steels and carbonaceous materials such as diamonds and metallic or non-metallic carbides.

The bell portion 18 of the die forms the inlet portion of the body member and preferably has a bell angle A that does not create forces which interfere with the operation of the die. For most applications, it is believed that the bell angle may be between about 15° and about 35°, preferably from about 20° to about 30°. Of course, the proper bell angle depends to a certain extent upon the size and physical properties of the workpiece. For some workpieces, the bell angle needed for smooth operation may be outside the above-identified range. The axial length of the bell portion 18 is a function of the bell angle and the diameter of the bore 22.

The land portion 20 preferably has a bore diameter substantially equal to the desired final outer dimension for the workpiece. Its length should be consistent with the goals of maintaining smooth die operation and substantially avoiding the creation of harmful frictional forces. For forming relatively thin walled tubular structures, the land length may be in the range of about $\frac{1}{8}$ inch to about one inch, preferably from about $\frac{1}{4}$ inch to about $\frac{1}{2}$ inch.

To remove from the die interior any solid particles that have become dislodged in the die, a helical groove 26 is recessed into the interior of the body member 12. The groove 26 preferably extends from the inlet face 14 of the die to the outlet face 16 of the die. The helical groove may be formed in any suitable manner known in the art during fabrication of the die and may have one or more turns. During operation, the groove 26 comes into contact with the workpiece passing through the die and any loose and/or dislodged particles moving along therewith. These loose and/or dislodged particles enter the groove 26 and are ultimately expelled from the die when they reach the groove exit.

For efficient die operation, the groove needs to be large enough to accommodate the passage of the solid particles yet small enough not to significantly undermine the operating characteristics of the die. It is believed that a groove having both a width and a depth that is from about 5% to about 15%, preferably from about 8% to about 12%, of the diameter of bore 22 will be sufficient to permit passage of the dislodged particles without creating defects in the surface of the workpiece.

The helical groove 26 may impart torsional forces to the workpiece which acts as rifling and which cause the workpiece to rotate. Where this rotation is acceptable, there is no need to counteract it. Where this rotation is unacceptable, the problem can be overcome by counter-rotating the die at a reasonably high rate of speed during the working operation. This can be accomplished by mounting the die 10 within a rotatable holder 28 formed from any suitable material known in the art. The die 10 may be mounted within the holder 28 in any suitable fashion known in the art. A suitable drive means 30 may be provided to rotate the die 10 and its holder 28 counter to the rotation imparted to the workpiece. Any suitable drive means known in the art such as a motor and belt drive may be used to rotate the die and its holder. Rotation of the die is also desirable to insure that each part of the workpiece sees the groove and the working portions of the die.

A suitable speed at which the die may be rotated may be determined from the following equation:

$$S_r = S_i/(L \times N) \quad (1)$$

where $S_r$ = Speed of Rotation;

$S_i$ = Input Speed of Workpiece;

L = Contact Length of the Die; and

N = Number of Turns of the Groove.

For example, to form a tube at an input speed of 30 feet/minute using a die having a $\frac{1}{4}$ inch contact length and a one turn helical groove, the die, in accordance with equation (1), should be rotated at about 1440 rpm. to assure complete forming. If the above die had a three turn helical groove, then it should be rotated at a speed of about 480 rpm.

Obviously, rotation of the die will increase the frictional problems associated with the working operation. If desired, this problem can be at least in part alleviated by using the groove 26 as a lubricant passageway as well as a means for removing unwanted particles. By using the groove in this manner, lubricant can be delivered to the workpiece/die interface. This can be particularly advantageous in a tube forming operation because the net drawing force needed to form the tube can be significantly reduced. Reduction in net drawing force are desirable because they allow tube forming with heavier gages of materials or with stronger materials.

Figure 3:
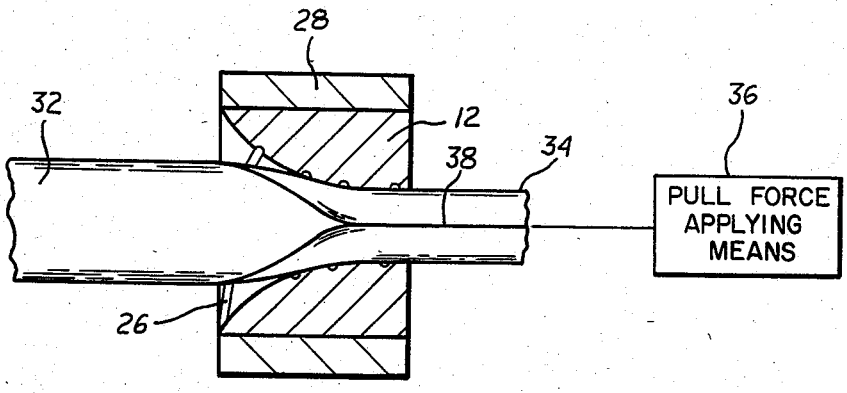
FIG. 3 is a cross sectional view of the die of FIG. 1 being used to form a tubular structure.

The die of the present invention may be used to work a variety of metals or metal alloys including, but not limited to, copper and copper alloys, stainless steel and its alloys, and iron and iron alloys. The die of the present invention may also be used in conjunction with a variety of working techniques. As shown in FIG. 3, the die 10 may be used to form a continuous strip 32 of metal or metal alloy into a tube 34 characterized by a generally longitudinally extending seam 38 formed by spaced apart edges of the strip material. This can be done by applying a pull force or drawing force to the metal or metal alloy strip using any suitable force applying means 36 known in the art and pulling the strip material through the die. The force applying means 36 may, for example, comprise a take-up reel or a capstan. As previously mentioned, it is desirable during the tube forming operation to rotate the die 10 at a rotational speed in accord with equation (1).

If desired, the die 10 of the present invention may be used as a drawing die or a sizing die. In either of these operations, a workpiece not shown such as a metal or metal alloy wire or tube may be pulled through the die in any suitable manner by the application of a pull force by any suitable force applying means known in the art.

While the holder 28 has been described as being a rotatable holder, it should be recognized that where there is no need to rotate the die, the holder 28 may be a stationary holder.

While the die 10 has been illustrated as having a generally circular transverse cross section, it may have any desired cross sectional configuration.

The U.S. Patents set forth in the specification are intended to be incorporated by reference herein.

It is apparent that there has been provided in accordance with this invention a die having a solid particle removing groove which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed:

1. A tube forming die comprising:

means for forming a metal or metal alloy strip into a tubular structure, said forming means including a body member having an inlet through which said strip enters, an outlet through which said tubular structure exits, a passageway between said inlet and outlet in which said strip if formed into said tubular structure, and means for removing solid particles from said passageway; and said removing means comprising a helical groove extending from said inlet to said outlet.

2. The die of claim 1 further comprising:

said passageway being defined by a bell portion and an adjacent land portion; and said helical groove being recessed into both said bell portion and said land portion.

3. The die of claim 2 further comprising:

said bell portion having a frusto-conical configuration; and said land portion having a substantially cylindrical bore.

4. The die of claim 1 further comprising:

said helical groove having at least one turn.

5. The die of claim 1 further comprising:

said helical groove having a plurality of turns.

6. The die of claim 3 further comprising:

said groove having a width and a depth sufficient to accommodate passage of said particles without substantially interfering with the formation of said tubular structure, both said width and said depth being from about 5% to about 15% of the diameter of said bore.

7. The die of claim 6 further comprising:

said width and depth being from about 8% to about 12% of said bore diameter.

8. The die of claim 1 further comprising:

means for rotating said body member.

9. The die of claim 8 wherein said rotating means comprises:

a rotatable housing in which said body member is mounted; and drive means for rotating said housing and said body member at a desired rate of speed.

10. A process for forming a relatively thin walled tubular structure from a continuous strip of metal or metal alloy, said process comprising:

providing a die having an interior passageway and a helical groove recessed into said passageway;

passing said metal or metal alloy strip through said die to form said tube; and removing solid particles from the interior of said die by passing them through said helical groove and thereby promoting efficient operation of said tube forming die.

11. The process of claim 10 further comprising:

rotating said die to counteract any torsional force on said tube caused by said helical groove.

12. The process of claim 11 further comprising:

rotating said die at a speed in accordance with the following equation:

$$S_r = S_i/(L \times N) \quad (1)$$

where $S_r$ = desired speed of rotation;

$S_i$ = input speed of said metal or metal alloy strip;

L = contact length of said die; and

N = number of turns of said groove.

13. The process of claim 10 wherein said rotating step comprises:

mounting said die into a rotatable holder; and rotating said holder.

* * * * *